US011421415B2

(12) United States Patent
Blevins et al.

(10) Patent No.: US 11,421,415 B2
(45) Date of Patent: Aug. 23, 2022

(54) HYBRID FOUNDATION SYSTEM

(71) Applicant: Home Pride, Inc., Nashville, TN (US)

(72) Inventors: William B. Blevins, Nashville, TN (US); Andrew W. Oliphant, Brentwood, TN (US); Claude E. Hammonds, Duffield, VA (US); Jason M. Wilson, Hendersonville, TN (US)

(73) Assignee: Home Pride, Inc., Nashville, TN (US)

( * ) Notice: Subject to any disclaimer, the term of this patent is extended or adjusted under 35 U.S.C. 154(b) by 27 days.

(21) Appl. No.: 17/003,277

(22) Filed: Aug. 26, 2020

(65) Prior Publication Data

US 2022/0064932 A1 Mar. 3, 2022

(51) Int. Cl.

| | |
|---|---|
| ***E04B 1/34*** | (2006.01) |
| ***E04B 1/343*** | (2006.01) |
| ***E02D 27/50*** | (2006.01) |
| ***E02D 27/48*** | (2006.01) |
| ***E02D 5/80*** | (2006.01) |

(52) U.S. Cl.

CPC ..... *E04B 1/34352* (2013.01); *E02D 5/80* (2013.01); *E02D 27/48* (2013.01); *E02D 27/50* (2013.01); *E04B 1/34347* (2013.01)

(58) Field of Classification Search

CPC ... E04B 1/34352; E04B 1/34347; E02D 5/80; E02D 27/48; E02D 27/50

See application file for complete search history.

(56) References Cited

U.S. PATENT DOCUMENTS 3,713,259 A * 1/1973 Tkach ..... E04B 1/34342 52/111
4,791,766 A * 12/1988 Egri, II ..... E04B 1/941 52/317
4,882,887 A * 11/1989 Giles ..... E04B 1/34352 52/126.6
5,509,237 A * 4/1996 Coulter ..... B60P 3/36 52/126.6
5,564,248 A * 10/1996 Callies ..... F16B 9/058 52/702
5,697,725 A * 12/1997 Ballash ..... E04B 1/2608 403/231
6,209,268 B1 * 4/2001 Schmidt ..... E04B 1/2608 52/665
6,230,448 B1 5/2001 Oliver et al.
6,332,299 B1 * 12/2001 Stewart, III ..... E04B 1/2608 52/506.05
6,334,279 B1 1/2002 Oliver et al.
6,342,996 B1 1/2002 Drapkin et al.
(Continued)

*Primary Examiner* — Adriana Figueroa
(74) *Attorney, Agent, or Firm* — Lucian Wayne Beavers; Alex H. Huffstutter; Patterson Intellectual Property Law, PC

(57) ABSTRACT

A foundation support system for supporting a manufactured building from a ground surface, includes a pan configured to engage the ground surface. The pan includes a longitudinal bracket integrally formed in the pan. The bracket includes a pair of spaced walls extending in a longitudinal direction. First and second longitudinal struts include first and second lower strut ends, respectively, received between and attached to the spaced walls of the longitudinal bracket. The pan may also include an integrally formed lateral bracket which receives a lateral strut. The pan may include integral reinforcing ribs extending parallel to and between the walls of each bracket.

20 Claims, 7 Drawing Sheets

(56) References Cited

U.S. PATENT DOCUMENTS 6,345,484 B1 2/2002 Oliver et al.
6,381,907 B1 * 5/2002 MacKarvich ..... E04B 1/34352 52/105
6,415,572 B1 7/2002 Mackarvich
6,418,685 B1 7/2002 Oliver et al.
6,505,447 B1 * 1/2003 Oliver ..... E02D 27/01 52/292
6,546,686 B2 4/2003 Mackarvich
6,622,439 B2 * 9/2003 Moreno, Jr. ..... E02D 27/01 52/155
6,634,150 B1 10/2003 Oliver et al.
6,725,613 B2 4/2004 Oliver et al.
6,871,455 B1 3/2005 Cockman et al.
6,928,783 B2 8/2005 Oliver et al.
7,140,157 B2 * 11/2006 Oliver ..... E02D 27/01 52/292
7,313,892 B1 1/2008 Oliver et al.
7,526,899 B1 5/2009 Oliver et al.
8,833,020 B2 * 9/2014 Oliver ..... E02D 31/14 52/292
8,844,209 B1 9/2014 Oliver et al.
8,919,060 B1 12/2014 Oliver et al.
9,206,580 B2 12/2015 Oliver et al.
9,932,718 B2 * 4/2018 Blevins ..... E04H 9/021
9,970,175 B2 5/2018 Oliver et al.
10,161,098 B2 12/2018 Oliver et al.
10,415,243 B2 * 9/2019 Schmidt ..... E04B 2/7457
2002/0170253 A1 * 11/2002 MacKarvich ..... E02D 27/34 52/292
2003/0213197 A1 * 11/2003 Oliver ..... E02D 27/01 52/299
2016/0362863 A1 12/2016 Oliver et al.
2019/0186097 A1 6/2019 Oliver et al.
2020/0115879 A1 4/2020 Oliver et al.

* cited by examiner

HYBRID FOUNDATION SYSTEM

FIELD OF THE DISCLOSURE

The present disclosure relates to a foundation system for supporting manufactured housing from a ground surface with a plurality of struts for preventing the manufactured building from moving longitudinally and/or laterally.

BACKGROUND

Manufactured buildings, including mobile homes, generally include longitudinal support beams situated underneath. The manufactured building is built upon these longitudinal support beams. These buildings are typically supported by a plurality piers or jacks positioned between a ground surface and the support beams for supporting the building. These piers and/or jacks, however, provide no stabilization against longitudinal forces and/or lateral forces that may be exerted on the building, for example, by weather events, such as strong winds or earthquakes.

Prior foundation systems may include a foundation pan for engaging the ground surface using spikes. Said foundation pans may include brackets welded or bolted thereto for coupling to longitudinal and/or lateral struts. The struts may then be coupled to select support beams of the manufactured building for stabilizing the building longitudinally and/or laterally. The struts may optionally be used to support the beams above the ground surface as well. The brackets may be fashioned from material substantially similar to the foundation pan. When bolted to the foundation pan, the brackets create structurally weak points of the system which may be prone to fail, especially if not installed correctly by a user. The added material cost of the brackets, welding time and/or additional installation hardware (i.e., bolts, nuts, washers, lock washers, or the like) may substantially increase the unit cost of the foundation system. Additional issues affecting said foundation plates include pan flexing due to point loading and issues with rigidity.

SUMMARY OF THE DISCLOSURE

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The present disclosure provides a foundation system which includes a pan having an integrally formed longitudinal bracket. The longitudinal bracket is formed by folding spaced longitudinal walls of the longitudinal bracket upward from the pan. The pan may further include an integrally formed lateral bracket formed by folding spaced lateral walls of the lateral bracket upward form the pan. By integrally forming the longitudinal and lateral brackets from the pan, the foundation system may be manufactured at a reduced cost as compared to previous systems. The pan may further include a first reinforcing ridge positioned between the spaced longitudinal walls of the longitudinal bracket and/or a second reinforcing ridge positioned between the spaced lateral walls of the lateral bracket. The reinforcing ridge may be pressed into the pan and may increase the rigidity of the pan and reduce pan flexion.

In one embodiment of a foundation system for supporting a manufactured building from a ground surface as disclosed herein, the foundation system comprises a pan and first and second longitudinal struts. The pan may be configured to engage the ground surface. The pan may include a longitudinal bracket integrally formed in the pan. The longitudinal bracket may include a pair of spaced walls extending in a longitudinal direction. The first and second longitudinal struts may include first and second lower strut ends, respectively, which may be configured to be received between and attached to the spaced walls of the longitudinal bracket.

In one exemplary aspect of the aforementioned embodiment, the pan may be formed from a metal sheet that defines a planar upper surface of the pan. Additionally, the spaced walls of the longitudinal bracket may be folded upward from the planar upper surface to create openings in the planar upper surface laterally outward of the spaced walls.

In another exemplary aspect of the aforementioned embodiment, the pan may further includes a reinforcing ridge integrally formed in the pan between and parallel to the spaced walls of the longitudinal bracket.

In another exemplary aspect of the aforementioned embodiment, the spaced walls of the longitudinal bracket may each have a wall length in the longitudinal direction. Additionally, the reinforcing ridge has a ridge length in the longitudinal direction. The ridge length may be longer than the wall length of either of the spaced walls. Furthermore, the reinforcing ridge may extend longitudinally beyond both ends of each of the spaced walls of the longitudinal bracket.

In another exemplary aspect of the aforementioned embodiment, the ridge length may be at least twice the wall length of either of the spaced walls.

In another exemplary aspect of the aforementioned embodiment, the spaced walls may each include two transverse wall connector openings spaced apart in the longitudinal direction and aligned with corresponding wall connector openings of the other spaced wall to form first and second pairs of aligned wall connector openings. Additionally, the lower strut ends of the first and second longitudinal struts may include first and second transverse strut connector openings, respectively, configured to be aligned with the first and second pairs of aligned wall connector openings, respectively, such that the first and second longitudinal struts may be separately connected to the longitudinal bracket by first and second transverse connectors extending through the first and second pairs of aligned wall connector openings and the first and second transverse strut connector openings, respectively.

In another exemplary aspect of the aforementioned embodiment, the pan may further include a lateral bracket integrally formed in the pan. The lateral bracket may include a pair of spaced lateral bracket walls extending in a lateral direction perpendicular to the longitudinal direction. Additionally, the foundation system may further include a lateral strut having a lower end configured to be attached to the lateral bracket.

In another exemplary aspect of the aforementioned embodiment, the pan may further include a lateral reinforcing ridge integrally formed in the pan between and parallel to the pair of spaced lateral bracket walls and extending in the lateral direction.

In another exemplary aspect of the aforementioned embodiment, the pan may be rectangular in plan shape and may include first and second edges extending in the longitudinal direction and third and fourth edges extending in the lateral direction. The spaced walls of the longitudinal bracket may be located on opposite sides of a longitudinally extending centerline of the pan. Additionally, the spaced walls of the longitudinal bracket may each have their ends substantially equally spaced from the third and fourth edges, so that the longitudinal bracket is centrally located on the pan. Finally, the lateral bracket may be located adjacent to one of the first and second edges.

In another exemplary aspect of the aforementioned embodiment, the pan may be rectangular in plan shape having four corners. The pan may include first and second upturned edges extending in the longitudinal direction and third and fourth upturned edges extending in a lateral direction perpendicular to the longitudinal direction. The pan may include a right angle shaped opening adjacent each of the four corners. Each right angle shaped opening may be configured to receive a right angle shaped spike driven through the right angle shaped opening to anchor the pan longitudinally and laterally relative to the ground surface.

In another exemplary aspect of the aforementioned embodiment, the pan may further include a plurality of bolt openings configured to receive concrete bolts so that the pan can alternatively be bolted to a concrete foundation covering the ground surface.

In another exemplary aspect of the aforementioned embodiment, the pan may be rectangular in plan shape having four corners. The pan may include first and second downturned edges extending in the longitudinal direction and third and fourth downturned edges extending in a lateral direction perpendicular to the longitudinal direction. The downturned edges may be configured to be driven downward into the ground surface to anchor the pan longitudinally and laterally relative to the ground surface.

In another embodiment of a foundation system for supporting a manufactured building from a ground surface as disclosed herein, the foundation system comprises a pan, first and second longitudinal struts, and a lateral strut. The pan may be formed from a metal sheet defining a planar upper surface of the pan. The pan may be rectangular in plan shape having four corners, and may further include first and second edges extending in a longitudinal direction and third and fourth edges extending in a lateral direction perpendicular to the longitudinal direction. Additionally, the pan may further include a longitudinal bracket and a lateral bracket. The longitudinal bracket may be formed by bending first and second longitudinally extending walls upward from the metal sheet. The first and second longitudinally extending walls may be laterally spaced from each other on opposite sides of a longitudinally extending centerline of the pan. The lateral bracket may be formed by bending first and second laterally extending walls upward from the metal sheet. The first and second longitudinal struts may include first and second lower longitudinal strut ends, respectively, which may be configured to be received between and attached to the walls of the longitudinal bracket. The lateral strut may include a lower lateral strut end which may be configured to be received between and attached to the walls of the lateral bracket.

In one exemplary aspect of the aforementioned embodiment, the pan may further include a reinforcing ridge integrally formed in the pan between and parallel to the longitudinally extending walls of the longitudinal bracket.

In another exemplary aspect of the aforementioned embodiment, the longitudinally extending walls of the longitudinal bracket may each have a wall length in the longitudinal direction. Additionally, the reinforcing ridge may have a ridge length in the longitudinal direction. The ridge length may be longer than the wall length of either of the longitudinally extending walls Additionally, the ridge may extend longitudinally beyond both ends of each of the longitudinally extending walls of the longitudinal bracket.

In another exemplary aspect of the aforementioned embodiment, the ridge length may be at least twice the wall length of either of the longitudinally extending walls of the longitudinal bracket.

In another exemplary aspect of the aforementioned embodiment, the longitudinally extending walls may each include two transverse wall connector openings spaced apart in the longitudinal direction and aligned with the wall connector openings of the other longitudinally extending wall to form first and second pairs of aligned wall connector openings. Additionally, the lower ends of the first and second longitudinal struts include first and second transverse strut connector openings, respectively, configured to be aligned with the first and second pairs of aligned wall connector openings, respectively, such that the first and second longitudinal struts may be separately connected to the longitudinal bracket by first and second transverse connectors extending through the first and second pairs of aligned wall connector openings and the first and second transverse strut connector openings, respectively.

In another exemplary aspect of the aforementioned embodiment, the pan may further include a lateral reinforcing ridge integrally formed in the pan between and parallel to the first and second laterally extending walls and extending in the lateral direction.

In another exemplary aspect of the aforementioned embodiment, the first, second, third and fourth edges of the pan may be upturned edges. Additionally, the pan may include a right angle shaped opening adjacent each of the four corners. Each right angle shaped opening may be configured to receive a right angle shaped spike driven through the right angle shaped opening to anchor the pan longitudinally and laterally relative to the ground surface.

In another exemplary aspect of the aforementioned embodiment, the first, second, third and fourth edges of the pan may be downturned edges and may further be configured to be driven downward into the ground surface to anchor the pan longitudinally and laterally relative to the ground surface.

Numerous objects, features and advantages of the present invention will be readily apparent to those skilled in the art upon a reading of the following disclosure when taken in conjunction with the accompanying drawings.

DETAILED DESCRIPTION

Figure 1:
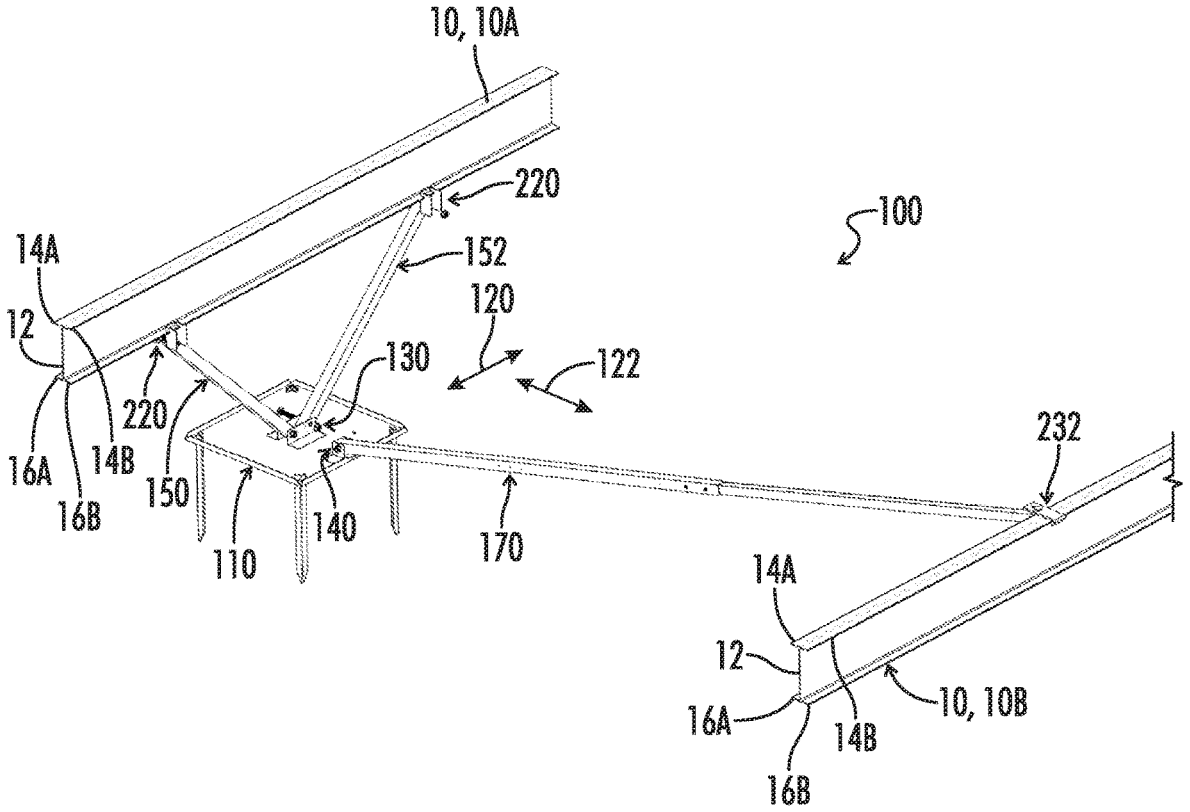
FIG. 1 is a perspective view of a foundation system attached to the support beams of a manufactured building.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

The words "connected", "attached", "joined", "mounted", "fastened", and the like should be interpreted to mean any manner of joining two objects including, but not limited to, the use of any fasteners such as screws, nuts and bolts, bolts, pin and clevis, and the like allowing for a stationary, translatable, or pivotable relationship; welding of any kind such as traditional MIG welding, TIG welding, friction welding, brazing, soldering, ultrasonic welding, torch welding, inductive welding, and the like; using any resin, glue, epoxy, and the like; being integrally formed as a single part together; any mechanical fit such as a friction fit, interference fit, slidable fit, rotatable fit, pivotable fit, and the like; any combination thereof; and the like.

Unless specifically stated otherwise, any part of the apparatus of the present disclosure may be made of any appropriate or suitable material including, but not limited to, metal, alloy, polymer, polymer mixture, wood, composite, or any combination thereof.

Figure 7:
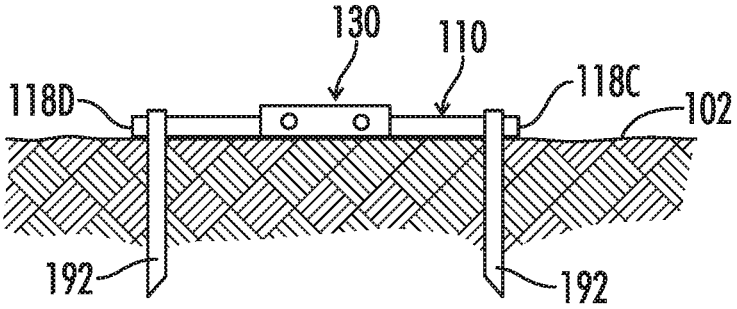
FIG. 7 is a schematic elevation cross-section view showing the pan of the foundation system of FIGS. 1 and 2 installed on a ground surface with four angled spikes.
Figure 8:
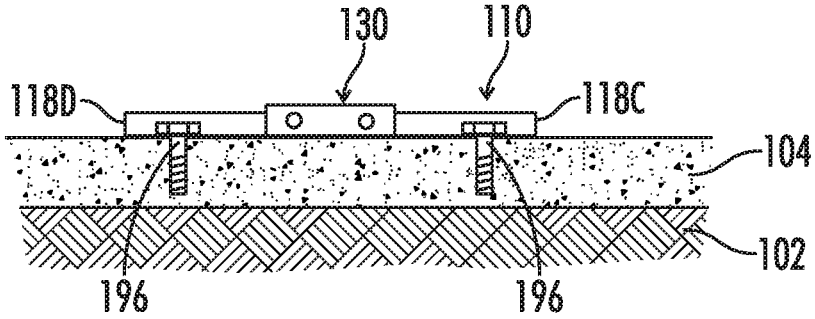
FIG. 8 is a schematic elevation cross-section view showing the pan of the foundation system of FIGS. 1 and 2 installed on a concrete pad with lag bolts.

Referring to FIG. 1, a foundation system 100 is shown. The foundation system 100 is configured for supporting a manufactured building (not shown) from a ground surface 102 (shown in FIGS. 7-9). The foundation system 100 is couplable to a plurality of beams 10 of the manufactured building for supporting the manufactured building from the ground surface 102.

As illustrated in FIGS. 1-2 and 5-6, the foundation system 100 may include a pan 110 configured to engage the ground surface 102. The pan 110 may be formed from a metal sheet 112 that defines a planar upper surface 114. The metal sheet 112 may also be referred to herein as sheet metal 112. The pan 110 may be rectangular in shape and have four corners 116 (e.g., 116A, 116B, 116C, 116D). Preferably the pan 110 is square. The pan 110 may further include first and second edges 118A, 118B extending parallel to a longitudinal direction 120 and third and fourth edges 118C, 118D extending parallel to a lateral direction 122. The longitudinal direction 120 may be defined perpendicular to the lateral direction 122. The first, second, third, and fourth edges 118A, 118B, 118C, 118D may be integrally formed from the sheet metal 112 and may extend perpendicularly relative to the planar upper surface 114. The first, second, third, and fourth edges 118A, 118B, 118C, 118D may help increase the rigidity of the pan 110. While the edges are not illustrated as connected at the four corners 116, they may in certain optional embodiments be welded together at each corner.

Figure 9:
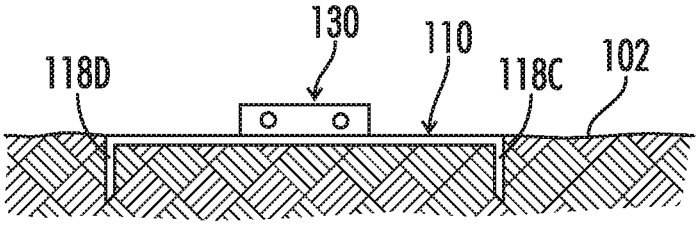
FIG. 9 is a schematic elevation cross-section view showing the pan of FIG. 6 installed on a ground surface with downward extending knife edges of the pan.

As illustrated in FIGS. 1, 2, 5, 7, and 8, the first, second, third, and fourth edges 118A, 118B, 118C, 118D may extend upward from the pan 110 relative to the planar upper surface 114. In FIGS. 1, 2, 5, 7, and 8, the first, second, third, and fourth edges 118A, 118B, 118C, 118D may also be referred to as first, second, third, and fourth upturned edges 118A, 118B, 118C, 118D. As illustrated in FIGS. 6 and 9, the first, second, third, and fourth edges 118A, 118B, 118C, 118D may extend downward from the pan 110 relative to the planar upper surface 114. In FIGS. 6 and 9, the first, second, third, and fourth edges 118A, 118B, 118C, 118D may also be referred to as first, second, third, and fourth downturned edges 118A, 118B, 118C, 118D and may be configured to be driven downward into the ground surface 102 to anchor the pan 110 longitudinally and laterally relative to the ground surface 102. The downturned edges may be welded together at each of the corners 116 (i.e., 116A, 116B, 116C, 116D) to prevent the first, second, third, and fourth downturned edges 118A, 118B, 118C, 118D from unfolding when driven into the ground surface 102.

The pan 110 may include a longitudinal bracket 130 integrally formed in the pan 110. The longitudinal bracket 130 may be formed by bending first and second longitudinally extending walls 132, 134 upward from the sheet metal 112. The first and second longitudinally extending walls 132, 134 may also be referred to herein as a pair of spaced walls 132, 134 extending in the longitudinal direction 120 (e.g., parallel to the longitudinal direction 120). Bending the first and second longitudinally extending walls 132, 134 upward from the sheet metal 112 creates first and second openings 136, 138 in the sheet metal 112 positioned laterally outward of the first and second longitudinally extending walls 132, 134, respectively. An integrally formed bracket such as 130 provides improved rigidity to the pan 110 because a portion of the pan 110 has been formed into a channel shape. Additionally, the use of an integral bracket such as 130 provides improved shear resistance as compared to a similar size separately formed bracket which is bolted to the pan.

The first and second longitudinally extending walls 132, 134 of the longitudinal bracket 130 may be located on opposite sides of a longitudinally extending centerline 124 of the pan 110. In other words, the first and second longitudinally extending walls 132, 134 may be laterally spaced from each other on opposite sides of the longitudinally extending centerline 124. Furthermore, each of the first and second longitudinally extending walls 132, 134 may be equally spaced from the longitudinally extending centerline 124. The first and second longitudinally extending walls 132, 134 may have their respective ends equally spaced from the third and fourth edges 118C, 118D of the pan 110 such that the longitudinal bracket is centrally located on the pan 110.

The pan 110 may further include a lateral bracket 140 integrally formed in the pan 110. The lateral bracket 140 may be formed by bending first and second laterally extending walls 142, 144 upward from the sheet metal 112. The first and second laterally extending walls 142, 144 may also be referred to herein as a pair of spaced walls 142, 144 extending in the lateral direction 122 (e.g., parallel to the lateral direction 122). Bending the first and second laterally extending walls 142, 144 upward from the sheet metal 112 creates third and fourth openings 146, 148 in the sheet metal 112 positioned longitudinally outward of the first and second laterally extending walls 142, 144, respectively.

Because the longitudinal and lateral brackets 130, 140 are integrally formed (or pressed) from the sheet metal 112 of the pan 110, this eliminates the need to make external brackets that must be bolted on or welded to the pan 110.

The lateral bracket 140 may be located adjacent to one of the first and second edges 118A, 118B of the pan 110. The first and second laterally extending walls 142, 144 of the lateral bracket 140 may be located on opposite sides of a laterally extending centerline 126 of the pan 110. In other words, the first and second laterally extending walls 142, 144 may be longitudinally spaced from each other on opposite sides of the laterally extending centerline 126. Furthermore, each of the first and second laterally extending walls 142, 144 may be equally spaced from the laterally extending centerline 126.

Figure 5:
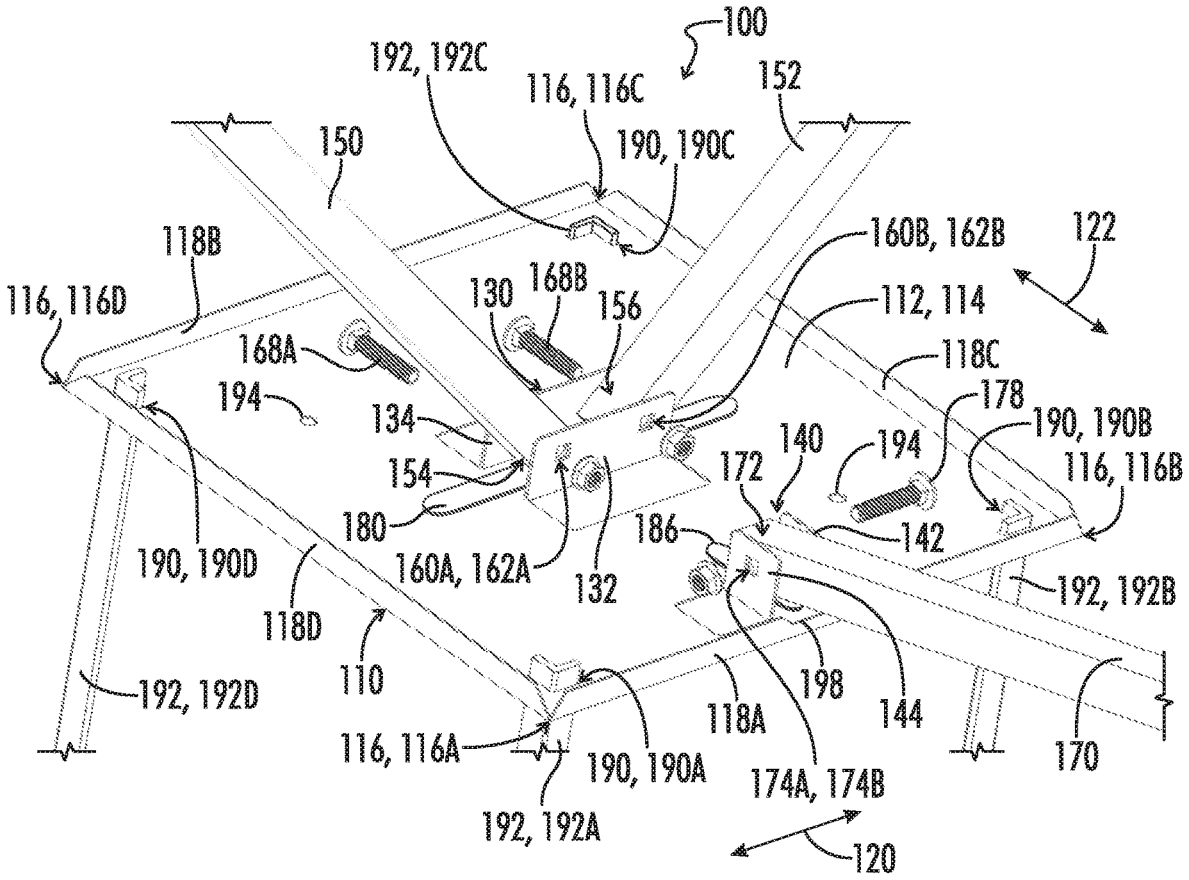
FIG. 5 is an enlarged perspective view of the pan as connected to the lower ends of the struts.
Figure 6:
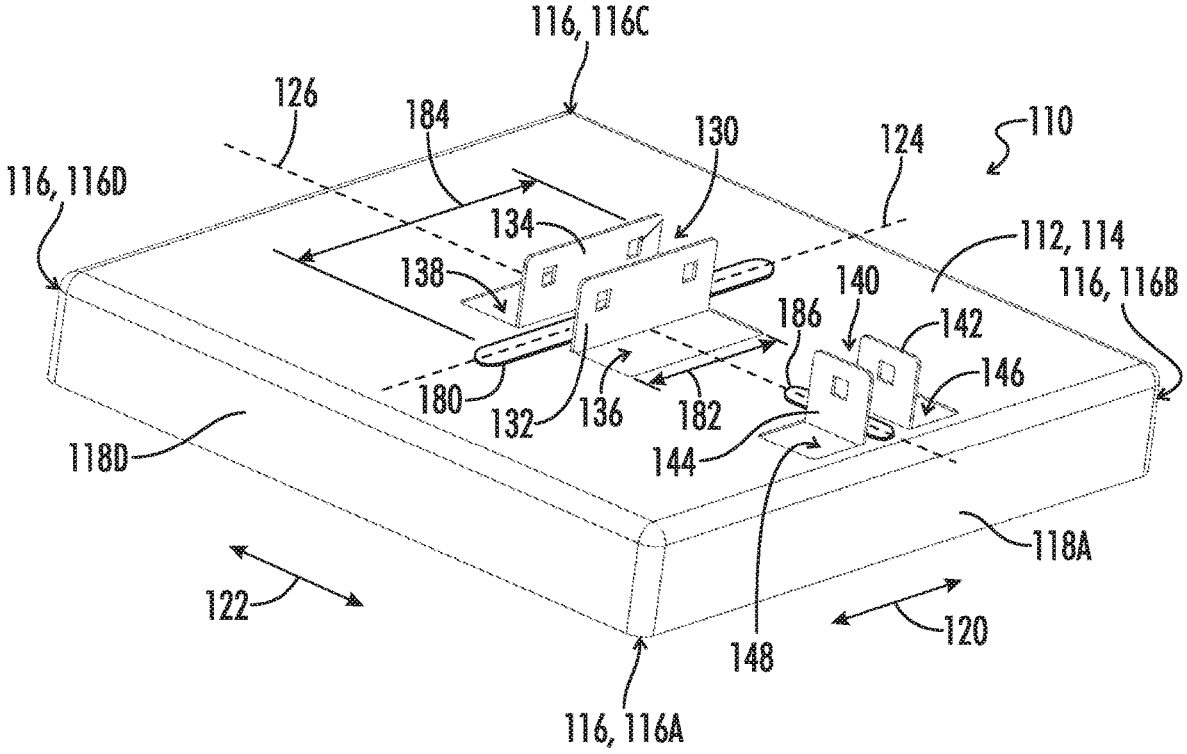
FIG. 6 is a perspective view of an alternative pan for use with the foundation system of FIG. 1.

As illustrated in FIGS. 1 and 5, the foundation system 100 may further include first and second longitudinal struts 150, 152. The first and second longitudinal struts 150, 152 may include first and second lower longitudinal strut ends 154, 156 configured to be received between and attached to the first and second longitudinally extending walls 132, 134 of the longitudinal bracket 130. The first and second lower longitudinal strut ends 154, 156 may also be referred to herein as first and second lower strut ends 154, 156.

The first and second lower longitudinal strut ends 154, 156 may each include first and second transverse strut connector openings 160A, 162A and 160B, 162B, respectively. Similarly, the first and second longitudinally extending walls 132, 134 may each include first and second transverse wall connector openings 164A, 166A and 164B, 166B, respectively, spaced apart in the longitudinal direction 120. The first transverse wall connector opening 164A of the first longitudinally extending wall 132 may align with the first transverse wall connector opening 164B of the second longitudinally extending wall 134 in the lateral direction 122 to define a first pair of aligned wall connector openings 164. Likewise, the second transverse wall connector opening 166A of the first longitudinally extending wall 132 may align with the second transverse wall connector opening 166B of the second longitudinally extending wall 134 in the lateral direction 122 to define a second pair of wall connector openings 166. The first and second transverse strut connector openings 160A, 162A of the first lower longitudinal strut end 154 may be configured to be aligned with the first pair of aligned wall connector openings 164. The first and second transverse strut connector openings 160B, 162B of the second lower longitudinal strut end 156 may be configured to be aligned with the second pair of aligned wall connector openings 166.

Each of the first and second longitudinal struts 150, 152 may be separately connected to the longitudinal bracket 130. For example, the first longitudinal strut 150 may be connected to the longitudinal bracket 130 using a first transverse connector 168A configured to extend through the first pair of aligned wall connector openings 164 and the first and second transverse strut connector openings 160A, 162A of the first lower longitudinal strut end 154. The second longitudinal strut 152 may be connected to the longitudinal bracket 130 using a second transverse connector 168B configured to extend through the second pair of aligned wall connector openings 166 and the first and second transverse strut connector openings 160B, 162B of the second lower longitudinal strut end 156.

The foundation system 100 may further include a lateral strut 170. The lateral strut 170 may include a lower lateral strut end 172 configured to be received between and attached to the first and second laterally extending walls 142, 144 of the lateral bracket 140. The lower lateral strut end 172 may include first and second transverse strut connector openings 174A, 174B. The first and second laterally extending walls 142, 144 may each include a transverse wall connector opening 176A, 176B aligned in the longitudinal direction 120. The lateral strut 170 may be connected to the lateral bracket 140 using a transverse connector 178 configured to extend through transverse wall connector openings 176A, 176B and first and second transverse strut connector openings 174A, 174B of the lower lateral strut end 172.

As illustrated in FIGS. 1, 2, 5, and 6, the pan 110 may further include a longitudinal reinforcing ridge 180 integrally formed in the pan 110 between and parallel to the first and second longitudinally extending walls 132, 134 of the longitudinal bracket 130. Each of the first and second longitudinally extending walls 132, 134 may include a longitudinal wall length 182 in the longitudinal direction 120. The longitudinal wall length 182 may also be referred to herein as a wall length 182. The longitudinal reinforcing ridge 180 may include a longitudinal ridge length 184 in the longitudinal direction 120. The longitudinal ridge length 184 may also be referred to herein as a ridge length 184. The longitudinal ridge length 184 may be longer than the longitudinal wall length 182 of either of the first and second longitudinally extending walls 132, 134. In certain optional embodiments, the longitudinal reinforcing ridge 180 may extending longitudinally beyond both ends (not labeled) of each of the first and second longitudinally extending walls 132, 134. In other optional embodiments, the longitudinal ridge length 184 may be at least twice the longitudinal wall length 182 of either of the first and second longitudinally extending walls 132, 134.

The pan 110 may further include a lateral reinforcing ridge 186 positioned integrally formed in the pan 110 between and parallel to the first and second laterally extending walls 142, 144 of the lateral bracket 140. The lateral reinforcing ridge 186 may extend laterally away from the nearest first or second edge 118A, 118B and beyond at least one end (not labeled) of each of the first and second laterally extending walls 142, 144.

Each of the longitudinal reinforcing ridge 180 and the lateral reinforcing ridge 186 may be pressed into the pan 110 either downward into the planar upper surface 114 of the pan 110 or upward above the planar upper surface 114 of the pan 110. When the foundation system 100 is configured to be mounted to a concrete foundation 104 (shown in FIG. 8), as opposed to a ground surface 102 (shown in FIGS. 7 and 9) the longitudinal and lateral reinforcing ridges 180, 186 may be pressed into the pan 110 upward above the planar upper surface 114 of the pan 110 so as to not interfere with the concrete foundation 104. The longitudinal and lateral reinforcing ridges 180, 186 may be configured to help increase the rigidity of the pan 110 and reduce pan flex due to the first, second, third, and fourth openings 136, 138, 146, 148 of the pan 110.

Figure 2:
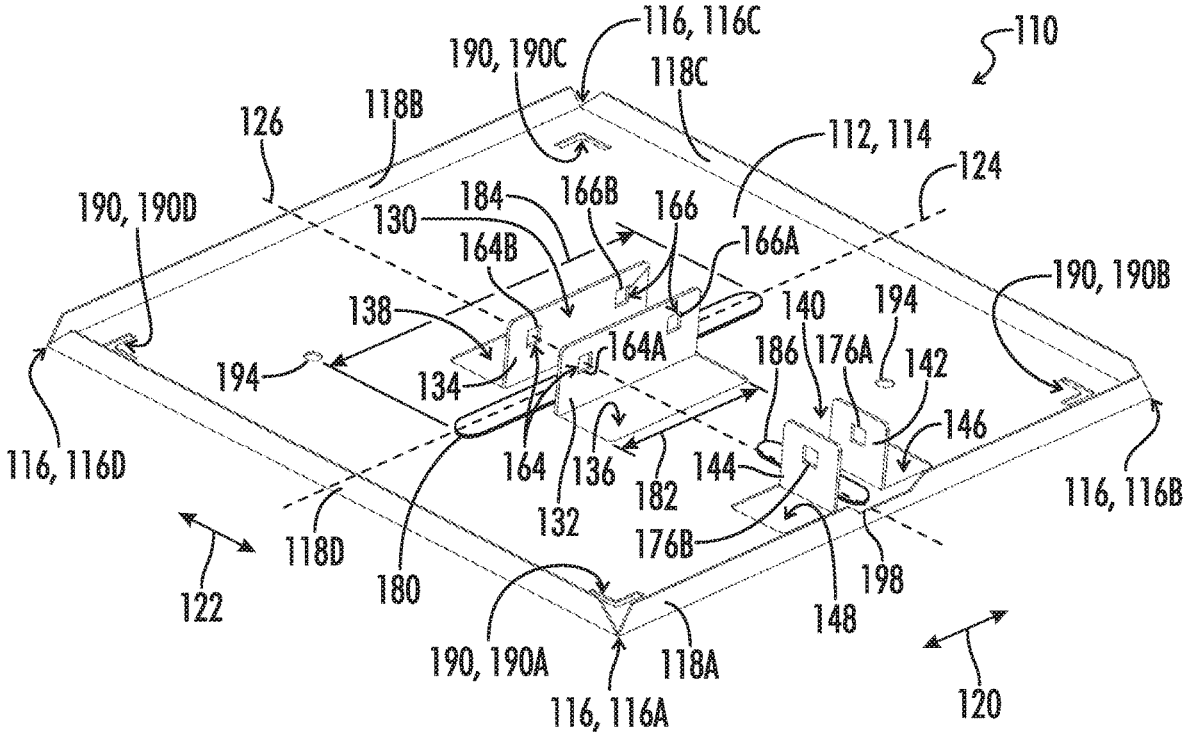
FIG. 2 is an enlarged perspective view of the pan of the foundation system of FIG. 1.

As illustrated in FIG. 2, the pan 110 may include right angle shaped openings 190 (i.e., 190A, 190B, 190C, 190D) positioned adjacent to each of the four corners 116 (i.e., 116A, 116B, 116C, 116D). Each of the right angle shaped openings 190A, 190B, 190C, 190D may be configured to receive a right angle shaped spike 192A, 192B, 192C, 192D, respectively. Each of the right angle shaped spikes 192A, 192B, 192C, 192D may be driven through a corresponding right angle shaped opening 190A, 190B, 190C, 190D to anchor the pan 110 longitudinally and laterally to the ground surface 102. Each of the right angle shaped spikes 192A, 192B, 192C, 192D may be formed by typical angle iron or other material.

As illustrated in FIGS. 1 and 5, the pan 110 may further include a plurality of bolt openings 194 configured to receive concrete bolts 196 (shown in FIG. 8) for bolting the pan 110 to the concrete foundation 104 covering the ground surface 102. This is particularly applicable when the first, second, third, and fourth edges 118A, 118B, 118C, 118D are upturned edges.

As illustrated, the lateral bracket 140 is positioned adjacent to the first edge 118A. The first edge 118A may include a recess 198 for accommodating the lateral strut 170 when an angle (not shown) of the lateral strut 170 is small relative to the planar upper surface 114 of the pan 110. The recess 198 may help avoid any interference that the first edge 118A may have with the lateral strut 170.

The plurality of beams 10 of the manufactured building may extend in the longitudinal direction 120. Each beam of the plurality of beams 10 of the manufactured building may be I-beams and may include a vertical portion 12, first and second upper flange portions 14A, 14B extending from opposite sides of an upper end of the vertical portion 12 parallel to the lateral direction 122, and first and second lower flange portions 16A, 16B extending from opposite sides of a lower end of the vertical portion 12 parallel to the lateral direction 122. The first and second upper flange portions 14A, 14B of each of the plurality of beams 10 are configured to support the manufactured building.

Figure 3A:
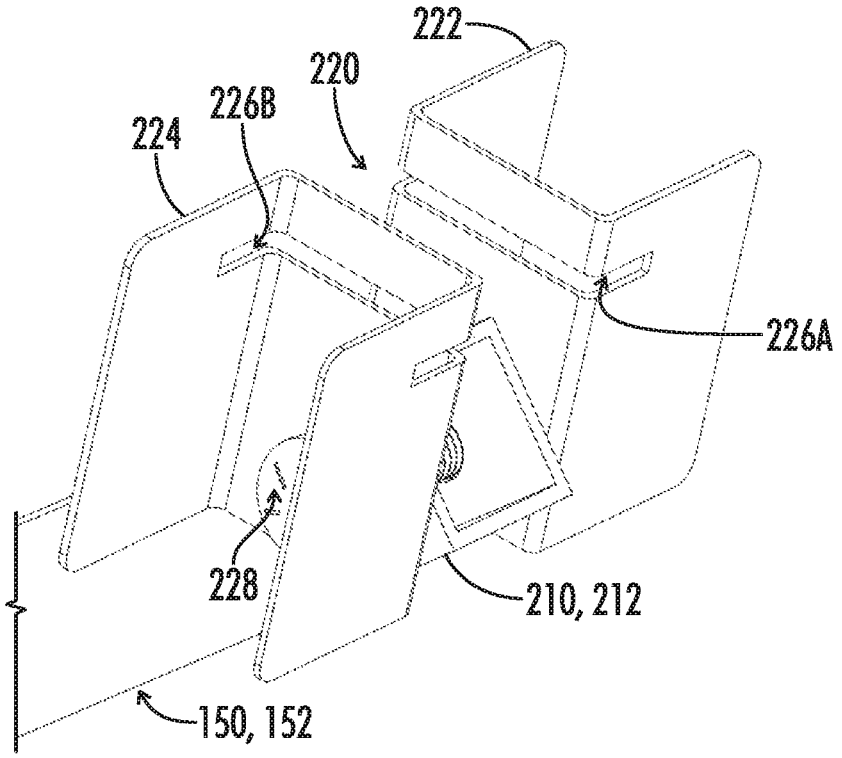
FIG. 3A is an enlarged perspective view of an upper end connector for connecting the longitudinal struts to a first beam.

As illustrated in FIG. 3A, each of the first and second longitudinal struts 150, 152 may include first and second upper longitudinal strut ends 210, 212 configured to be coupled to a first beam 10A of the plurality of beams 10 of the manufactured building. Each of the first and second upper longitudinal strut ends 210, 212 may include a longitudinal strut clamp 220 configured to couple each of the first and second upper longitudinal strut ends 210, 212 of the first and second longitudinal struts 150, 152 to the first beam 10A, and more specifically, to the first and second lower flange portions 16A, 16B of the first beam 10A. The longitudinal strut clamp 220 may also be referred to herein as an upper end connector 220 or a longitudinal strut upper connector 220.

The longitudinal strut clamp 220 may include a first clamping member 222 and a second clamping member 224. The first and second clamping members 222, 224 may be formed by U-shaped steel, bent from sheet metal, or the like. Each of the first and second clamping members 222, 224 may include a channel 226A, 226B, respectively, for receiving the first and second lower flange portions 16A, 16B of the first beam 10A. The first and second clamping members 222, 224 may be configured to simultaneously clamp on to the first beam 10A and attach to the first or second upper longitudinal strut end 210, 212 using a bolt 228 extending through transverse openings of each of the first and second clamping members 222, 224 and transverse openings of one of the first or second upper longitudinal strut end 210, 212.

Figure 3B:
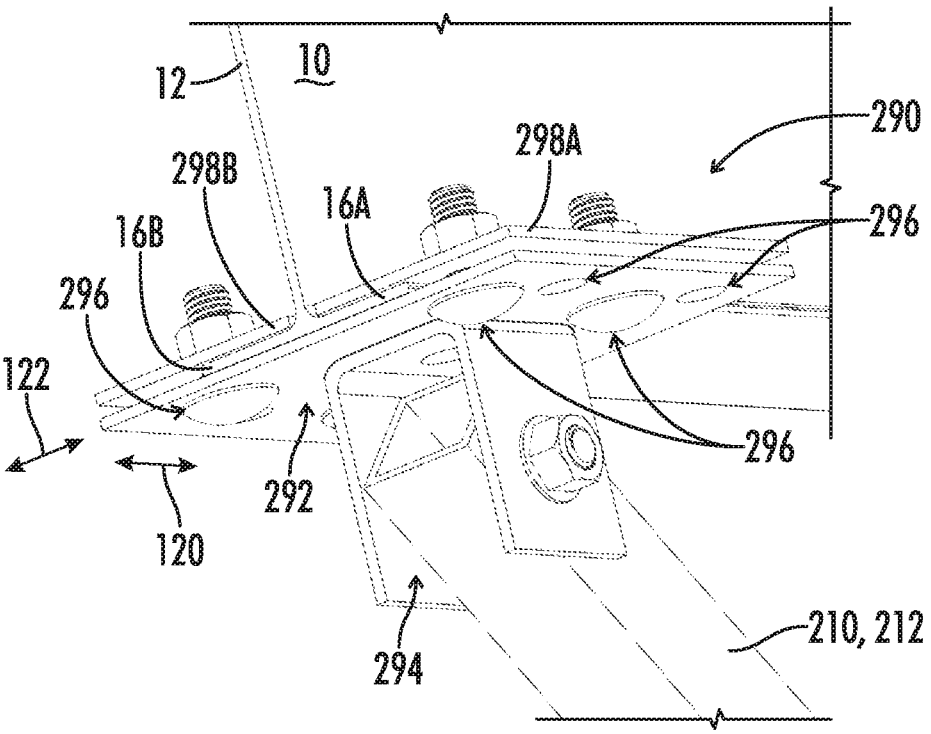
FIG. 3B is an enlarged perspective view of another embodiment of an upper end connector for connecting the longitudinal struts to a first beam.

FIG. 3B illustrates an alternative upper end connector 290. The longitudinal strut upper connector 290 may also be referred to as an upper end connector 290 or a longitudinal strut clamp 290. As illustrated in FIG. 3B, the longitudinal strut upper connector 290 may include a base plate 292 with a channel 294 extending downward therefrom for connecting to the upper end of each of the first and second longitudinal struts 210, 212. The base plate 292 includes a plurality of pairs of connector holes 296. Each pair of connector holes may be aligned in the longitudinal direction 120 with different pairs spaced apart in the lateral direction 122. The longitudinal strut upper connector 290 may further include first and second clamp plates 298A, 298B which may be bolted to selected pairs of the plurality of pairs of connector holes 296 depending on a beam width of each of the at least one beam 10 of the manufactured housing (e.g., beams widths of 3-inches, 4 inches, or the like). For example, the first lower flange portion 16A of the at least one beam 10 (e.g., the first beam 10A) may be sandwiched between the base plate 292 and the first clamp plate 298A of the longitudinal strut upper connector 290. Likewise, the second lower flange portion 16B of the at least one beam 10 (e.g., the first beam 10A) may be sandwiched between the base plate 292 and the second clamp plate 298B of the longitudinal strut upper connector 290.

The first and second longitudinal struts 150, 152 may be configured to support the first beam 10A and prevent the first beam 10A from moving in the longitudinal direction 120.

Figure 4A:
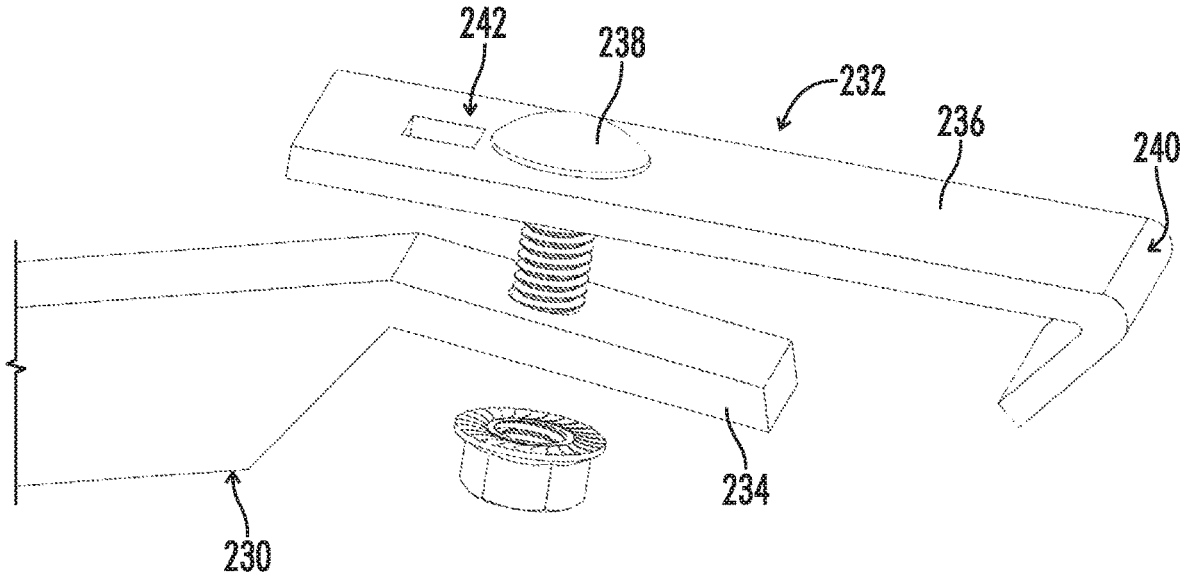
FIG. 4A is an enlarged perspective view of an upper end connector for the lateral strut to a second beam.

As illustrated in FIG. 4A, the lateral strut 170 may include an upper lateral strut end 230 configured to be coupled to a second beam 10B of the plurality of beams 10 of the manufactured building using a lateral strut clamp 232. The lateral strut clamp 232 may also be referred to herein as an upper end connector 232 or a lateral strut upper connector 232. The second beam 10B may be parallel to and spaced apart from the first beam 10A in the lateral direction 122. The upper lateral strut end 230 may be crimped flat or include a flat extension welded thereto to define a flat portion 234 of the lateral strut clamp 232. The flat portion 234 may be angled slightly relative to the lateral strut 170. The lateral strut clamp 232 may further include a J-shaped connector portion 236 couplable to the flat portion 234 using a bolt 238.

The J-shaped connector portion 236 may include a hooked end portion 240 and a straight end portion 242. The hooked end portion may be configured to receive one of the first or second upper flange portions 14A, 14B of the second beam 10B. The other one of the first or second upper flange portions 14A, 14B of the second beam 10B may be clamped between the straight end portion 242 of the J-shaped connector portion 236 and the flat portion 234 of the upper lateral strut end 230 using the bolt 238. The straight end portion 242 may include at least two holes spaced in the lateral direction 122 configured to receive the bolt depending upon a width of the second beam 10B such that the hooked end portion 240 and the flat portion 234 are able to engage the second beam 10B. The second beam 10B may, for example, be a 3-inch wide beam or a 4-inch wide beam.

The lateral strut 170 may be telescopic such that the upper lateral strut end 230 may be properly aligned relative to the second beam 10B and to prevent the second beam 10B from moving in the lateral direction 122.

Figure 4B:
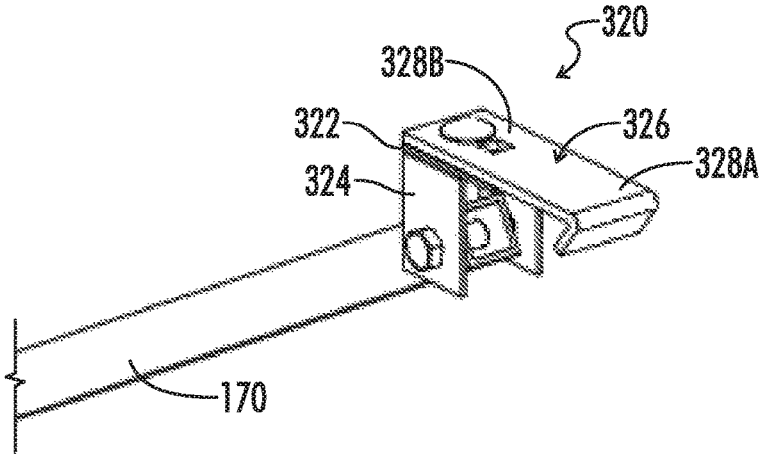
FIG. 4B is an enlarged perspective view of another embodiment of an upper end connector for the lateral strut to a second beam.

FIG. 4B illustrates an alternative lateral strut upper connector 320 configured to couple the lateral strut 170 to the at least one beam 10, for example, the second beam 10B, of the manufactured building. The lateral strut upper connector 320 may also be referred to as an upper end connector 320 or a lateral strut clamp 320. As illustrated in FIG. 4B, the lateral strut upper connector 320 may include a base plate 322 with a channel 324 extending downward therefrom for connecting to the upper end of the lateral strut 170. The lateral strut upper connector 320 may further include a J-shaped connector portion 326 couplable to the base plate 322. The J-shaped connector portion 326 may include a hooked end portion 328A and a straight end portion 328B. The hooked end portion 328A may be configured to receive one of the first or second upper flange portions 14A, 14B of the second beam 10B. The other one of the first or second upper flange portions 14A, 14B of the second beam 10B may be clamped between the straight end portion 328B of the J-shaped connector portion 326 and the base plate 322 using the bolt. The straight end portion 328B may include at least two holes spaced in the lateral direction 122, each of the two holes may receive the bolt depending upon a width of the second beam 10B such that both the hooked end portion 328A and the base plate 322 are able to engage the second beam 10B. The second beam 10B may, for example, be a 3-inch wide beam, a 4-inch wide beam, or the like.

Thus, it is seen that the apparatus and methods of the present disclosure readily achieve the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims. Each disclosed feature or embodiment may be combined with any of the other disclosed features or embodiments.

What is claimed is:

1. A foundation system for supporting a manufactured building from a ground surface, comprising:

a pan configured to engage the ground surface, the pan formed from a metal sheet defining a planar upper surface of the pan, the pan including a longitudinal bracket integrally formed in the pan, the longitudinal bracket including a pair of spaced walls extending in a longitudinal direction, the spaced walls folded upward from the planar upper surface creating openings in the planar upper surface laterally outward of the spaced walls; and first and second longitudinal struts including first and second lower strut ends, respectively, configured to be received between and attached to the spaced walls of the longitudinal bracket.

2. The foundation system of claim 1, wherein:

the pan further includes a reinforcing ridge integrally formed in the pan between and parallel to the spaced walls of the longitudinal bracket.

3. The foundation system of claim 2, wherein:

the spaced walls of the longitudinal bracket each have a wall length in the longitudinal direction; and the reinforcing ridge has a ridge length in the longitudinal direction, the ridge length being longer than the wall length of either of the spaced walls, and the reinforcing ridge extending longitudinally beyond both ends of each of the spaced walls of the longitudinal bracket.

4. The foundation system of claim 3, wherein:

the ridge length is at least twice the wall length of either of the spaced walls.

5. The foundation system of claim 1, wherein:

the spaced walls each include two transverse wall connector openings spaced apart in the longitudinal direction and aligned with corresponding wall connector openings of the other spaced wall to form first and second pairs of aligned wall connector openings; and the lower strut ends of the first and second longitudinal struts include first and second transverse strut connector openings, respectively, configured to be aligned with the first and second pairs of aligned wall connector openings, respectively, such that the first and second longitudinal struts may be separately connected to the longitudinal bracket by first and second transverse connectors extending through the first and second pairs of aligned wall connector openings and the first and second transverse strut connector openings, respectively.

6. The foundation system of claim 1, wherein:

the pan further includes a lateral bracket integrally formed in the pan, the lateral bracket including a pair of spaced lateral bracket walls extending in a lateral direction perpendicular to the longitudinal direction; and the foundation system further includes a lateral strut having a lower end configured to be attached to the lateral bracket.

7. The foundation system of claim 6, wherein:

the pan further includes a lateral reinforcing ridge integrally formed in the pan between and parallel to the pair of spaced lateral bracket walls and extending in the lateral direction.

8. The foundation system of claim 6, wherein:

the pan is rectangular in plan shape and includes first and second edges extending in the longitudinal direction and third and fourth edges extending in the lateral direction;

the spaced walls of the longitudinal bracket are located on opposite sides of a longitudinally extending centerline of the pan, and the spaced walls of the longitudinal bracket each have their ends substantially equally spaced from the third and fourth edges, so that the longitudinal bracket is centrally located on the pan; and the lateral bracket is located adjacent to one of the first and second edges.

9. The foundation system of claim 1, wherein:

the pan is rectangular in plan shape having four corners, and the pan includes first and second upturned edges extending in the longitudinal direction and third and fourth upturned edges extending in a lateral direction perpendicular to the longitudinal direction; and the pan includes a right angle shaped opening adjacent each of the four corners, each right angle shaped opening being configured to receive a right angle shaped spike driven through the right angle shaped opening to anchor the pan longitudinally and laterally relative to the ground surface.

10. The foundation system of claim 9, wherein:

the pan further includes a plurality of bolt openings configured to receive concrete bolts so that the pan can alternatively be bolted to a concrete foundation covering the ground surface.

11. The foundation system of claim 1, wherein:

the pan is rectangular in plan shape having four corners, and the pan includes first and second downturned edges extending in the longitudinal direction and third and fourth downturned edges extending in a lateral direction perpendicular to the longitudinal direction, the downturned edges being configured to be driven downward into the ground surface to anchor the pan longitudinally and laterally relative to the ground surface.

12. A foundation system for supporting a manufactured building from a ground surface, comprising:

a pan formed from a metal sheet defining a planar upper surface of the pan, the pan being rectangular in plan shape having four corners, and the pan including first and second edges extending in a longitudinal direction and third and fourth edges extending in a lateral direction perpendicular to the longitudinal direction, wherein the pan includes:

a longitudinal bracket formed by bending first and second longitudinally extending walls upward from the metal sheet creating openings in the planar upper surface, the first and second longitudinally extending walls being laterally spaced from each other on opposite sides of a longitudinally extending centerline of the pan; and a lateral bracket formed by bending first and second laterally extending walls upward from the metal sheet;

first and second longitudinal struts including first and second lower longitudinal strut ends, respectively, configured to be received between and attached to the walls of the longitudinal bracket; and a lateral strut including a lower lateral strut end configured to be received between and attached to the walls of the lateral bracket.

13. The foundation system of claim 12, wherein:

the pan further includes a reinforcing ridge integrally formed in the pan between and parallel to the longitudinally extending walls of the longitudinal bracket.

14. The foundation system of claim 13, wherein:

the longitudinally extending walls of the longitudinal bracket each have a wall length in the longitudinal direction; and the reinforcing ridge has a ridge length in the longitudinal direction, the ridge length being longer than the wall length of either of the longitudinally extending walls, and the ridge extending longitudinally beyond both ends of each of the longitudinally extending walls of the longitudinal bracket.

15. The foundation system of claim 14, wherein:

the ridge length is at least twice the wall length of either of the longitudinally extending walls of the longitudinal bracket.

16. The foundation system of claim 12, wherein:

the longitudinally extending walls each include two transverse wall connector openings spaced apart in the longitudinal direction and aligned with the wall connector openings of the other longitudinally extending wall to form first and second pairs of aligned wall connector openings; and the lower ends of the first and second longitudinal struts include first and second transverse strut connector openings, respectively, configured to be aligned with the first and second pairs of aligned wall connector openings, respectively, such that the first and second longitudinal struts may be separately connected to the longitudinal bracket by first and second transverse connectors extending through the first and second pairs of aligned wall connector openings and the first and second transverse strut connector openings, respectively.

17. The foundation system of claim 12, wherein:

the pan further includes a lateral reinforcing ridge integrally formed in the pan between and parallel to the first and second laterally extending walls and extending in the lateral direction.

18. The foundation system of claim 12, wherein:

the first, second, third and fourth edges of the pan are upturned edges; and the pan includes a right angle shaped opening adjacent each of the four corners, each right angle shaped opening being configured to receive a right angle shaped spike driven through the right angle shaped opening to anchor the pan longitudinally and laterally relative to the ground surface.

19. The foundation system of claim 12, wherein:

the first, second, third and fourth edges of the pan are downturned edges and are configured to be driven downward into the ground surface to anchor the pan longitudinally and laterally relative to the ground surface.

20. A foundation system for supporting a manufactured building from a ground surface, comprising:

a pan configured to engage the ground surface, the pan including a longitudinal bracket integrally formed in the pan, the longitudinal bracket including a pair of spaced walls extending in a longitudinal direction and having a wall length in the longitudinal direction, the pan further including a reinforcing ridge integrally formed in the pan between and parallel to the spaced walls, the reinforcing ridge having a ridge length in the longitudinal direction, the ridge length being longer than the wall length of either of the spaced walls and extending longitudinally beyond both ends of each of the spaced walls of the longitudinal bracket; and first and second longitudinal struts including first and second lower strut ends, respectively, configured to be received between and attached to the spaced walls of the longitudinal bracket.

* * * * *